US005551454A

United States Patent [19]

Goncalves

[11] Patent Number: 5,551,454

[45] Date of Patent: Sep. 3, 1996

[54] ASSEMBLY FOR PACKAGING OF PRODUCTS FOR LIGHTENING THE HAIR, AND CORRESPONDING METHOD FOR LIGHTENING THE HAIR

[75] Inventor: Antonin Goncalves, Montmorency, France

[73] Assignee: L'Oreal, Paris, France

[21] Appl. No.: 255,737

[22] Filed: Jun. 7, 1994

[30] Foreign Application Priority Data

Jun. 7, 1993 [FR] France ..... 93 06762

[51] Int. Cl.[6] ..... A45D 19/00

[52] U.S. Cl. ..... 132/208; 132/202; 132/221; 222/92

[58] Field of Search ..... 132/209, 207, 132/202, 221, 208; 222/92

[56] References Cited

U.S. PATENT DOCUMENTS

| | | | |
|---|---|---|---|
| 1,690,654 | 11/1928 | Trotter | 222/92 |
| 3,064,802 | 11/1962 | Jess et al. . | |
| 3,261,381 | 7/1966 | Roach | 222/94 X |
| 4,023,602 | 5/1977 | Sparr, Sr. | 141/311 R |
| 4,114,632 | 9/1978 | Morganroth . | |
| 4,116,365 | 9/1978 | Morganroth . | |
| 4,183,366 | 1/1980 | Bartuska et al. | 132/208 |
| 4,209,027 | 6/1980 | Morganroth . | |
| 4,226,852 | 10/1980 | Tesmann et al. | 132/208 X |
| 4,506,783 | 3/1985 | Morganroth | 206/581 |
| 5,018,646 | 5/1991 | Billman et al. | 222/92 X |
| 5,165,558 | 11/1992 | Cargile | 215/100 R |
| 5,294,436 | 3/1994 | Cope et al. | 132/208 X |
| 5,295,610 | 3/1994 | Levison | 222/26 |

FOREIGN PATENT DOCUMENTS

| | | | |
|---|---|---|---|
| 0246835 | 11/1987 | European Pat. Off. . | |
| 3631142 | 3/1988 | Germany | 132/202 |

*Primary Examiner*—John G. Weiss
*Attorney, Agent, or Firm*—Staas & Halsey

[57] ABSTRACT

Assembly for packaging products for lightening the hair, containing, in one container, a flexible plastic sachet containing a bleaching powder, and a recipient containing a fluid developer. The sachet is fixed to a rigid head including an annular element forming a neck equipped with at least one thread, the sachet being closed by a cap screwed onto the annular element. The recipient is a tube of flexible material having a neck equipped with a thread for cooperating with the annular element. The tube is closed by a top which is screwed onto the thread of the tube neck. At least one element of the container is a dish for receiving the mixture of the powder and the developer for applying to the hair.

18 Claims, 4 Drawing Sheets

ASSEMBLY FOR PACKAGING OF PRODUCTS FOR LIGHTENING THE HAIR, AND CORRESPONDING METHOD FOR LIGHTENING THE HAIR

BACKGROUND OF THE INVENTION

1. Field of the Invention

The present invention relates to an assembly for packaging of products for lightening or bleaching the hair and to a method for lightening or bleaching the hair using such an assembly. In the present description and in the claims the terms "lightening" and "bleaching" will be used interchangeably, the two concepts differing only in the extent of the change of colour and therefore corresponding to the same action carried out to different degrees.

2. Description of the Prior Art

At present, in order to lighten or bleach the hair, a paste is prepared which is obtained by mixing, just before use, a bleaching powder containing a peroxygen salt and a developer, in most cases based on aqueous hydrogen peroxide, the mixture obtained is applied, either over the whole of the hair or on tufts, for a specific period of time, then, to finish, the hair is washed with water and dried. Unfortunately, during the mixing of the bleaching powder and the developer, a cloud of bleaching powder is formed which irritates the nasal mucosa and which releases an unpleasant smell.

In order to overcome this drawback, it has been proposed to store the bleaching powder in a plastic sachet and to mix the bleaching powder and the developer, inside the plastic sachet, by manual heading: a method of this type is described in U.S. Pat. No. 4,116,365 and in U.S. Pat. No. 4,506,783. However, with the method described in the abovementioned patents it is not possible to eliminate all the risks of a cloud of bleaching powder being released into the atmosphere, and it additionally involves relatively bulky packaging assemblies.

SUMMARY OF THE INVENTION

The object of the present invention is to propose a compact assembly with which it is possible to eliminate completely the release of an irritant cloud of bleaching powder into the atmosphere.

The present invention thus relates to an assembly for packaging of products for lightening the hair, containing, in one and the same container, a flexible plastic sachet containing a bleaching powder, and a recipient containing a developer in fluid form, wherein the sachet includes a bag made of flexible plastic material, fixed on a head which is made of rigid plastic material and has an annular element forming a neck equipped with at least one thread, the sachet being closed by a cap screwed on to the annular element; that the recipient is a tube of flexible material containing the developer in cream form, this tube including a neck equipped with a thread which is capable of cooperating with a thread of the annular element, the tube being closed by a top which is screwed on to the thread of its neck; and that at least one element of the container constitutes a dish capable of receiving the mixture of the powder and the developer with a view to its application on the hair.

In the present application and in the claims the term "developer in cream form" is understood to mean a developer in the form of a viscous paste or viscous gel which is nevertheless fluid.

In this packaging assembly, the sachet includes an annular element equipped with a thread which is capable of cooperating with the thread of the neck of the tube containing the developer in cream form; it is thus possible to avoid any release of a cloud of bleaching substance during mixing of the latter with the developer. In fact, according to the invention, after unscrewing the cap fixed on the sachet and the top fixed on the tube, the neck of the tube is screwed on to the annular element of the sachet and, by compressing the tube, the developer initially contained in the tube is introduced into the sachet without the pulverulent product being able to escape from the sachet, since the latter is sealed by the tube during the operation; moreover, since the developer is in cream form, it settles on the powder and forms a layer which prevents any release of a cloud of powder in the sachet; the result is that no particle of powder can escape from the sachet at the moment when the sachet is opened. Moreover, since the user then closes the sachet with the aid of the cap, before starting heading, there is again no possibility of a cloud of pulverulent product forming during the mixing stage.

According to a preferred embodiment of the assembly according to the invention, the neck of the tube includes an outer thread, the cap of the sachet includes an inner thread, and the annular element includes, on the one hand, an outer thread which is capable of cooperating with the thread of the cap, and, on the other hand, an inner thread which is capable of cooperating with the thread of the neck of the tube. The bleaching powder in the container is advantageously arranged at the bottom of the bag, the latter being folded in such a way that its part containing the powder is arranged opposite a first empty part of the bag situated in the vicinity of the attachment head of the sachet, and, between the part of the bag containing the powder and the fold of the bag, there is a second empty part, which is opposite a zone of the first empty part of the bag, the tube being arranged in line with the zone where the abovementioned first and second empty parts face each other, parallel to the fold of the bag. This arrangement, in which the bag is folded and in which the tube is arranged against two superposed empty zones of the folded bag, which as a result have a low thickness, makes it possible to reduce substantially the volume of the container and to obtain a compact assembly.

In the case where a certain quantity of water has to be added to the mixture in order to obtain a mixture which is more or less fluid depending on its use, the packaging assembly includes a measuring cup which is preferably equipped with at least one measuring level and a pouring spout. This measuring cup is advantageously fixed in a detachable manner to the outside of the container. It should be noted that, according to the invention, since the developer is in cream form, it is possible to introduce it into the packaging assembly by using a tube which contains the developer. If it is desired to obtain a more fluid mixture, water is subsequently introduced by means of the abovementioned measuring cup. It is thus possible to avoid having to store a liquid developer in a rigid bottle, which would necessitate a bulkier packaging assembly.

The container is preferably formed by a shell which is made of rigid or semi-rigid plastic and is equipped with a detachable cover, the assembly generally having the form of a right cylinder or prism. The shell can be used as a dish for pouring the mixture obtained by heading, before taking the mixture and applying it to the hair. According to a preferred embodiment, when the assembly includes a measuring cup, the container has the form of a right prism with a polygonal base, two adjacent faces of which form between them, to the outside of the container, an angle of less than 180° in order to constitute, to the outside of the container, a seat permitting the positioning of the measuring cup.

According to a preferred embodiment of the sachet, the end of the bag which is opposite the attachment head constitutes a bottom which is closed by a transverse weld seam in which two to four small rigid bars are set, the total length of these being at least equal to two thirds of the width of the bag at the area of the bottom. The small bars are preferably made of rigid plastic material. The presence of these small separate bars makes it possible to head the sachet in the width direction since the bag can be folded longitudinally between two small bars. However, the small bar assembly remains sufficiently rigid for it to be possible to roll the bag around the small bars in order to expel all of the mixture from the sachet. The transverse weld seam at the bottom of the bag advantageously defines, together with the longitudinal edges of the bag, rounded corners in order to avoid any retention of powder in the corners of the bag.

The bag is preferably made, at least partially, of a transparent plastic material in such a way as to allow the user to check on the homogeneity of the kneaded mixture during kneading. According to a preferred embodiment, the bag is composed of two sheets of plastic material, one of these sheets being transparent and the other opaque: the bag in this case comprises two longitudinal weld seams and one transverse weld seam at the bottom.

The sachet preferably has, over a certain height in the vicinity of the attachment head, and projecting on the plane passing through the bottom weld seam and through the axis of the attachment head, a width which decreases in the direction of the attachment head. The bag thus forms a funnel, as it were, which makes it easier for the mixture obtained after heading to flow out of the sachet.

The bag is advantageously manufactured from one or two sheets of flexible plastic material. These sheets can be made of polyethylene, for example, or of a multi-layer plastic composite including layers of (polyethylene terephthalate/polyethylene) or of layers of (polyethylene terephthalate/polyethylene/copolymer of ethylene and vinyl alcohol/polyethylene).

The packaging assembly can contain accessories, such as gloves, a perforated cap for bleaching of tufts, hooks for the tufts, or directions for use. It generally also contains an applicator, such as a brush, which can be used independently of the sachet, or an applicator capable of being screwed on to the annular element of the sachet, in place of the cap.

The present invention also relates to a method for lightening the hair using a packaging assembly according to the invention containing a bleaching powder and a fluid developer to be mixed prior to application, including the steps of:

a) a packaging assembly, such as has been described above, is opened, and the sachet containing the bleaching powder and the tube containing the developer are taken out, b) the cap which closes the sachet and the top which closes the tube are unscrewed, and the neck of the tube is screwed into the annular element of the attachment head of the sachet, c) the tube is compressed in such a way as to expel all its contents into the sachet, d) the tube is unscrewed in order to free the annular element, e) the sachet is closed by screwing the cap back on to the attachment head, f) the sachet is headed manually in such a way as to obtain a homogeneous mixture, g) the cap is unscrewed, h) the mixture which has been obtained by kneading is expelled from the sachet, and i) the mixture is applied to the hair, it is left to act for a period of time sufficient to obtain the desired lightening, and the hair is washed and dried.

If necessary, at the end of step d) a defined quantity of water, preferably measured using a measuring cup associated with the assembly, is introduced into the sachet, this measuring cup preferably being that fixed in a detachable manner to the outside of the container.

At the end of step g) it is possible, in accordance with a first alternative mode of implementation, to screw an applicator nozzle on to the attachment head of the sachet, in place of the cap, and to use this applicator nozzle to apply the mixture directly to the hair.

According to another alternative mode of implementation, at step h) the mixture is expelled into a dish formed by the container, and at step i) the mixture is taken from the dish with the aid of an applicator.

At step h) the mixture is preferably expelled by rolling the bag of the sachet around the small bars set in the weld seem at the bottom of the bag.

In order to explain more clearly the subject-matter of the invention, an embodiment thereof which is represented in the attached drawing will be described hereinbelow by way of purely illustrative and non-limiting examples.

DESCRIPTION OF THE PREFERRED EMBODIMENTS

Figure 1:
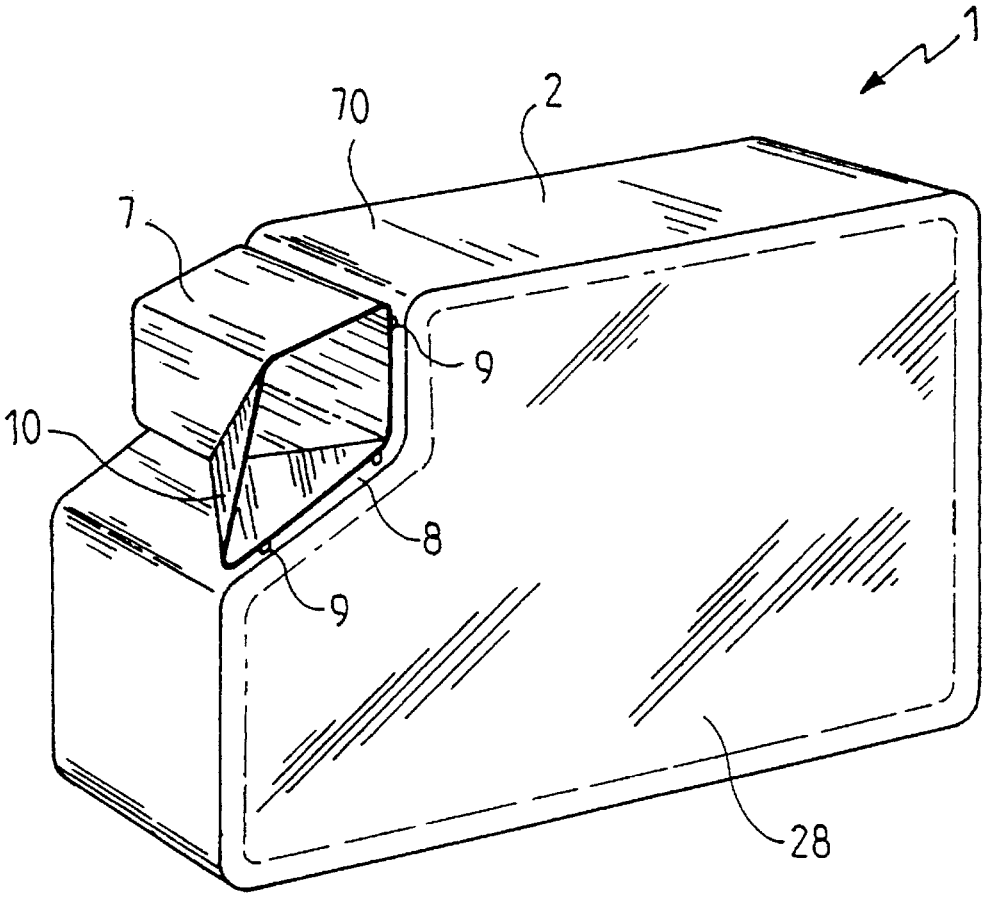
FIG. 1 is a perspective view of a packaging assembly according to the invention.
Figure 2:
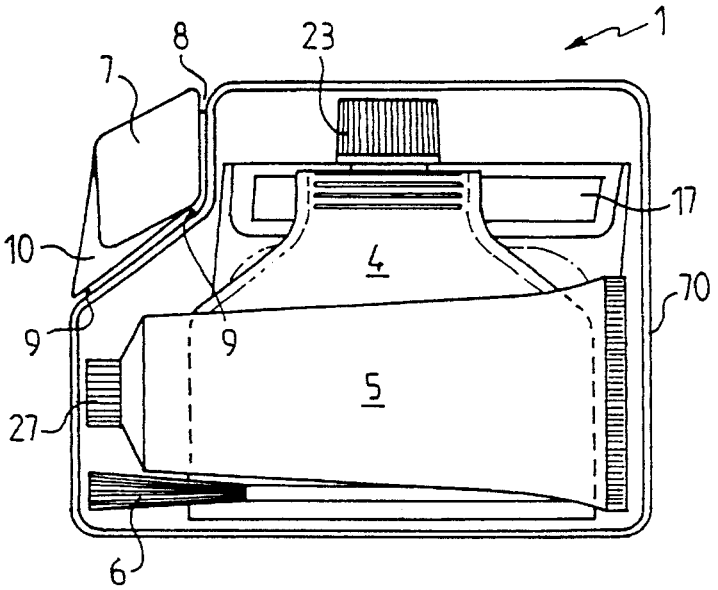
FIG. 2 is a plan view of the assembly when open, the assembly being placed on a horizontal surface.

FIGS. 1 and 2 represent a packaging assembly 1 according to the invention. This assembly includes a container formed by a shell 2 made of semi-rigid plastic, the bases of which have the shape of a rectangle, one of the corners 8 of which rectangle is indented in such a way as to form two sides constituting, to the outside, an angle of less than 180°; the side walls of the shell are perpendicular to the bases. This shell 2 is open on one of its bases, and a cover 28 fits on the side walls of the shell 2 in order to close it; in an alternative, the cover 28 could be replaced by a heat-sealed peel-off film on the edges of the shell 2. A sachet 4, a tube 5 and an applicator formed by a brush 6 are arranged in the shell 2.

Figure 3:
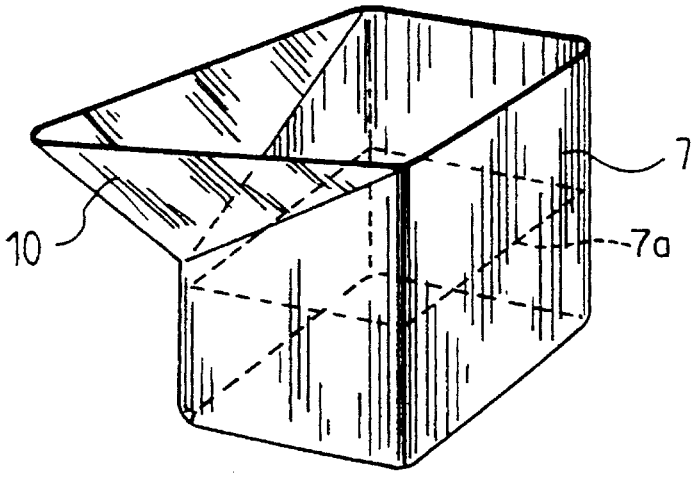
FIG. 3 is a detailed view of the measuring cup included in the assembly in FIG. 1.

A measuring cup 7 molded integrally with the shell 2 is fixed in the indented corner 8 of the shell 2; this measuring cup is attached to the shell 2 by spikes 9 which can be broken in order to detach the measuring cup 7 from the shell 2. The measuring cup 7 is represented in detail in FIG. 3: it has a general parallelepipedal form; a pouring spout 10 has been formed thereon. A line 7*a* is marked on its wall in order to indicate the level of filling to be observed.

Figure 4:
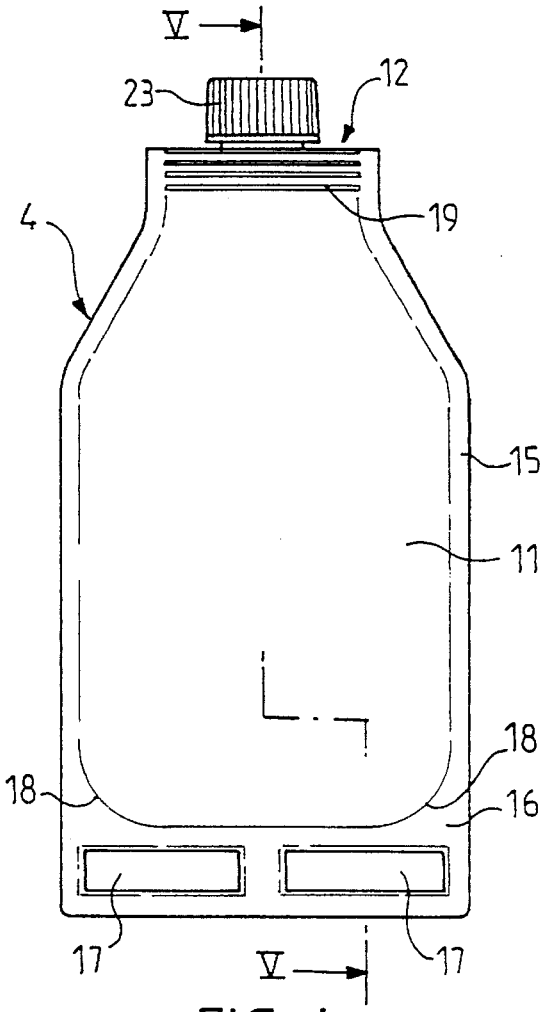
FIG. 4 is an elevation view of the sachet used for the assembly in FIG. 1.
Figure 5:
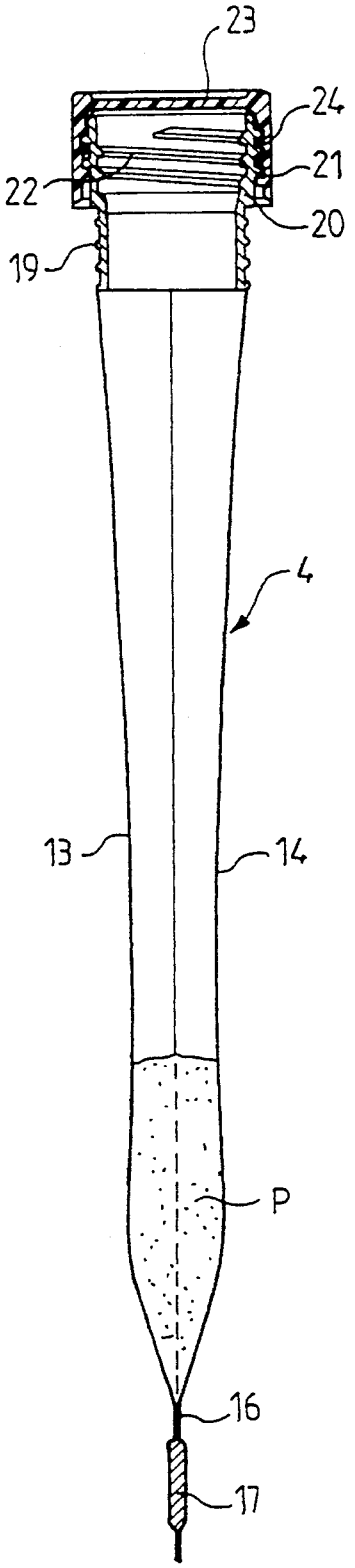
FIG. 5 is a longitudinal cutaway view of the sachet along V—V in FIG. 4.

The sachet 4 is illustrated in greater detail in FIGS. 4 and 5. It includes a bag 11 made of plastic material welded on to an attachment head 12. The bag 11 is formed by welding two sheets of plastic material 13 and 14, one of these sheets 13 being transparent and the other 14 being opaque. In order to form the bag, the two sheets 13 and 14 are welded laterally by weld seams 15 and, in order to form the bottom, by a transverse weld seam 16. Set within the bottom weld seam 16 are two small bars 17 made of rigid plastic. As can be seen in FIG. 4, the junction between the bottom weld seam 16 and the lateral weld seams 15 is in each case obtained by forming a rounded corner 18; it is thus possible, at the kneading stage, to prevent the bleaching powder from remaining trapped in the corners. The two plastic sheets 13 and 14 have, starting from the bottom weld seam 16, a constant width over a certain height, then a width which decreases in the direction of the mouth of the bag 11 in such a way as to form a funnel, as it were, which promotes the flow of the headed mixture.

The bag 11 is fixed on the attachment head 12, which is made of rigid plastic material. The head 12 is obtained in one piece by molding and includes two coaxial elements 19, 20. The first element 19 consists of a skirt having an oblong form in cross-section, and the outer surface of which is equipped with horizontal ribs in order to facilitate the attachment of the bag 11. The perimeter of the element 19 is close to the perimeter of the mouth of the bag 11 in such a way as to be able to engage and weld the bag on the element 19 without causing creases. The element 20 is connected via a shoulder to the element 19; it constitutes an annular element which forms a neck for filling and emptying the sachet 4. The annular element 20 is equipped with an outer thread 21 and an inner thread 22. The sachet 4 can be closed by a cap 23 which is equipped with an inner thread 24 capable of cooperating with the outer thread 21 of the annular element 20.

Before placing the sachet 4 in the shell 2, the bleaching powder P is introduced into the sachet 4 via the annular element 20 forming the neck. Following introduction of the powder P, the sachet 4 is pressed between two pushers in order to expel the air therefrom, and the cap 23 is screwed on. The sachet 4 is then folded in two parts which are superposed in such a way that the small bars 17 are situated at the level of the element 19 for attachment of the bag, while maintaining the powder in the vicinity of the bottom of the bag, in such a way as to keep an empty part on either side of the fold, the zone where these two empty parts are superposed being of low thickness. The sachet thus folded is arranged in the shell 2. The tube 5 containing the developer in cream form is arranged against the sachet 4, in line with the abovementioned zone of low thickness. In the shell 2, a brush 6 is arranged alongside the tube 5 at the level of the fold of the sachet 4.

Figure 6A:
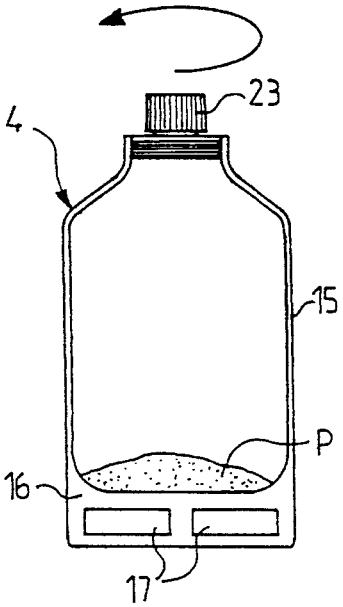
FIGS. 6A to 6E represent the different steps in a method for lightening the hair using the packaging assembly shown in FIGS. 1 to 5.
Figure 6B:
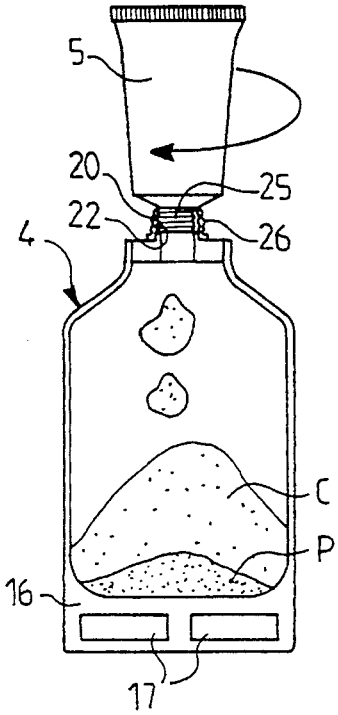

The tube 5 includes a neck 25 (see FIG. 6B) equipped with an outer thread 26 capable of cooperating with the inner thread 22 of the annular element 20. The tube is closed by a top 27 which is screwed on to the thread 26.

The relative arrangement of the sachet 4 in folded form and of the tube 5 at a zone of the folded sachet 4 where two parts empty of powder face each other makes it possible to obtain a very compact packaging assembly.

When a user wishes to use the packaging assembly described hereinabove, he proceeds in the manner illustrated diagrammatically in FIGS. 6A to 6E. He opens the shell 2 by lifting the cover 28 and removes the sachet 4 containing the powder P and the tube 5 containing the developer in cream form C. He unscrews the cap 23 of the sachet 4 and the top 27 of the tube 5, then screws the tube 5 into the annular element 20, the thread 26 of the neck 25 of the tube 5 cooperating with the inner thread 22 of the annular element 20 (see FIG. 6B). He then compresses the tube 5 in order to introduce into the sachet 4 all the cream C contained in the tube 5. During this operation, with the tube 5 closing the sachet 4, the bleaching powder cannot escape from the sachet. The user then unscrews the tube 5 in such a way as to free the annular element 20: the bleaching powder P cannot escape from the sachet 4 since it is covered by the cream C.

Figure 6C:
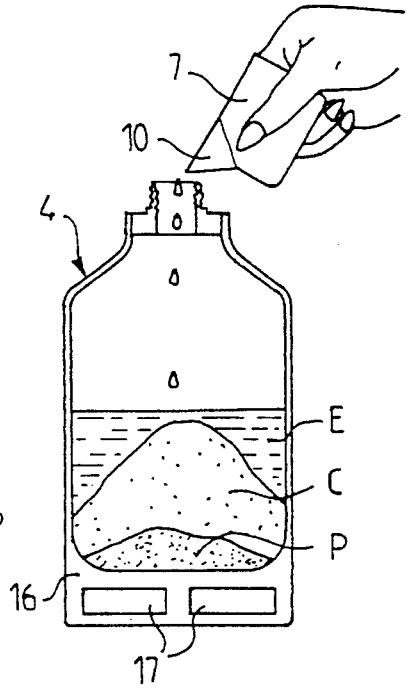
Figure 6D:
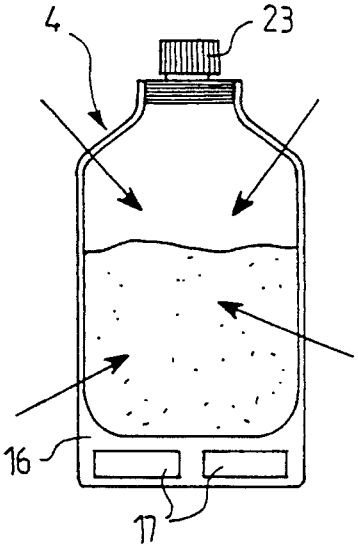
Figure 6E:
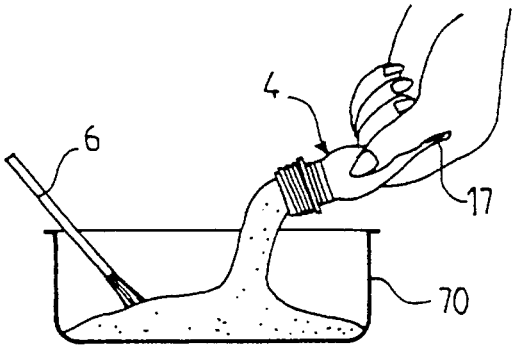

The user then detaches the measuring cup 7 from the shell 2 and pours water (E) into the measuring cup 7 up to the level indicated by a line: he pours this water (E) into the sachet 4 (see FIG. 6C). He then screws the cap 23 back on to the annular element 20 in order to close the sachet 4 and heads the mixture until it is homogeneous, it being possible to check the homogeneity of the mixture by sight through the transparent plastic face 13 of the sachet 4. It should be noted that the presence of the two small bars 17 does not in any way hamper the heading, since the sachet can be folded longitudinally between the two small bars. Finally, the user unscrews the cap 23 and empties the sachet 4 into the shell 2, which thus constitutes a dish 70; the complete emptying of the sachet 4 is achieved by rolling the bag 11 over the small rigid bars 17.

The mixture obtained by heading can then be taken from the dish 70 with the aid of the brush 6 in order to be applied to the hair.

Figure 7:
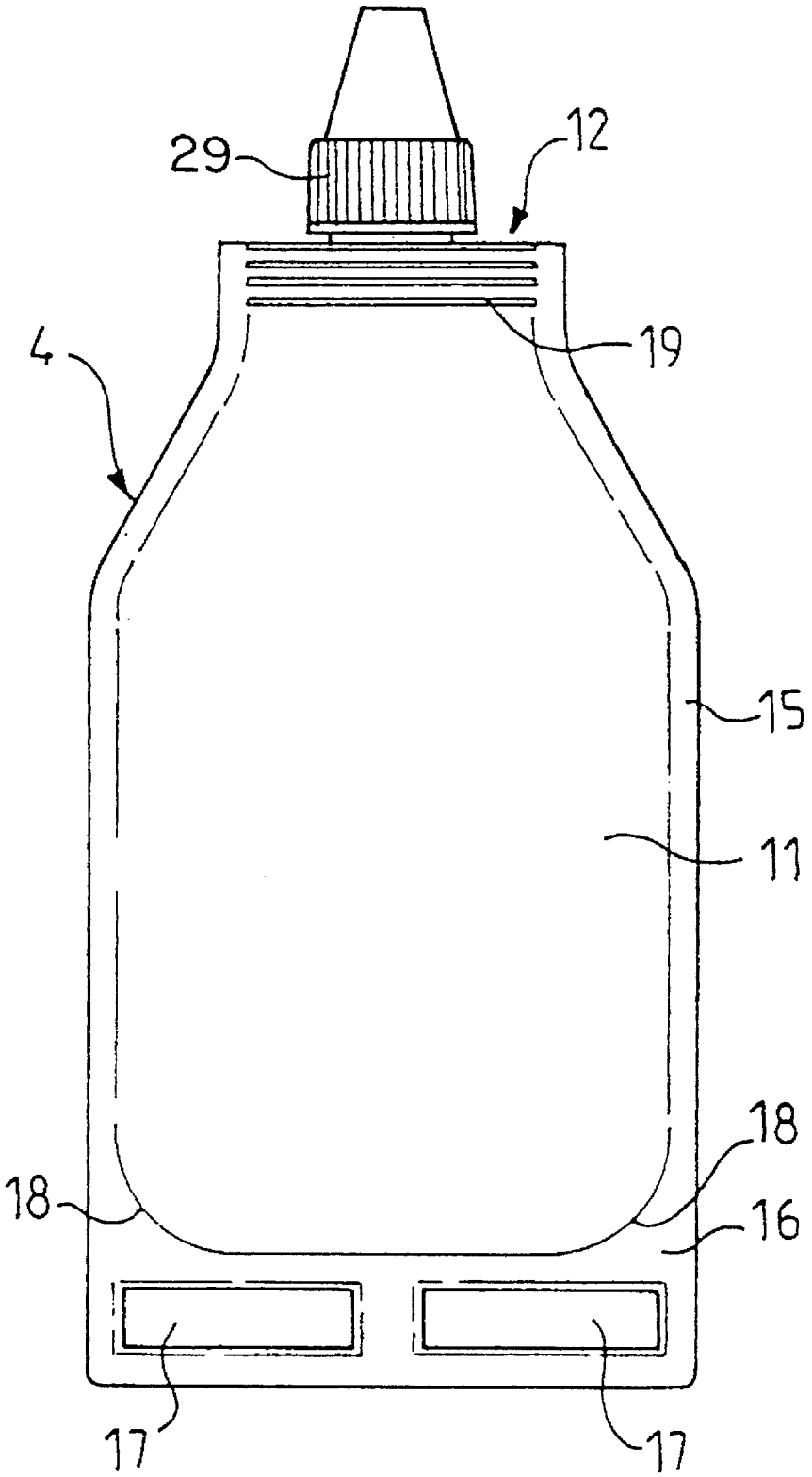
FIG. 7 is an elevational view of the sachet with an applicator nozzle thereon.

It is also possible, as shown in FIG. 7, to screw an applicator nozzle 29 on to the attachment head 12 of the sachet 7, in place of the cap 23, and to use this applicator nozzle 29 to apply the mixture directly to the hair.

I claim:

1. Assembly of products packaged for lightening the hair, comprising, in one container:

a flexible plastic sachet containing a bleaching powder;

a recipient containing a fluid developer, wherein the sachet includes a bag having an attachment head fixed thereon, said attachment head includes an annular element forming a neck equipped with at least one thread, the sachet is closed by a cap screwed on to the annular element, and wherein the recipient is a tube of flexible material, the tube including a neck equipped with a thread which can cooperate with the at least one thread of the annular element, the tube being closed by a top which is screwed on to the thread of the tube neck; and a dish for receiving a mixture of the powder and the developer for application on the hair.

2. Assembly according to claim 1, wherein the powder is arranged at the bottom of the bag, the bag is folded to form a first part containing the powder arranged opposite a first empty part of the bag situated in the vicinity of the attachment head of the sachet, and between the first part of the bag containing the powder and a fold of the bag, there is a second empty part, which is opposite the first empty part of the bag, the tube arranged in line with a zone where the first and second empty parts face each other, parallel to the fold of the bag.

3. Assembly according to claim 1, wherein the neck of the tube comprises an outer thread, wherein the cap comprises an inner thread, and wherein the annular element comprises an outer thread which cooperates with the inner thread of the cap, and an inner thread which cooperates with the outer thread of the neck of the tube.

4. Assembly according to claim 1, further comprising a measuring cup equipped with at least one measuring level and a pouring spout, the measuring cup being detachably fixed to an outside of the container.

5. Assembly according to claim 4, wherein the container has the general form of parallelpiped having one corner to which the measuring cup is secured.

6. Assembly according to claim 1, wherein an end of the bag which is opposite the attachment head constitutes a bottom which is closed by a transverse weld seam in which a plurality of small rigid bars are set, a total length of these bars being at least equal to two thirds of a width of the bag at said bottom.

7. Assembly according to claim 1, wherein the bag is made, at least partially, of a transparent plastic material.

8. Assembly according to claim 7, wherein the bag includes two sheets of plastic material which are welded together, one of these sheets being transparent and the other opaque.

9. Assembly according to claim 6, wherein the transverse weld seam at the bottom of the bag defines, together with the longitudinal edges of the bag, rounded corners.

10. Assembly according to claim 6, wherein the sachet has, over a certain height in the vicinity of the attachment head, and projecting on a plane passing through the weld seam and through an axis of the attachment head, a width which decreases in the direction of the attachment head.

11. Assembly according to claim 1, wherein the bag comprises a plurality of sheets of polyethylene.

12. Assembly according to claim 1, wherein the bag comprises a plurality of sheets of a multilayer plastic composite selected from the group polyethylene terephthalate/polyethylene/copolymer of ethylene and vinyl alcohol/polyethylene.

13. Assembly of products packaged for lightening the hair, comprising, in one container:

a flexible plastic sachet containing a bleaching powder;

a recipient containing a fluid developer, wherein the sachet includes a bag having an attachment head fixed thereon, said attachment head includes an annular element forming a neck equipped with at least one thread, and wherein the recipient is a tube of flexible material, the tube including a neck equipped with a thread which can cooperate with the at least one thread of the annular element, the tube being closed by a top which is screwed on to the thread of the tube neck;

a dish for receiving a mixture of the powder and the developer for application on the hair; and an applicator nozzle screwed onto the annular element.

14. Method for lightening the hair using a mixture from a packaging assembly containing a bleaching powder and a fluid developer mixed prior to application to the hair, comprising the steps of:

a) forming a packaging assembly according to claim 1;

b) opening the packaging assembly;

c) taking out the sachet containing the bleaching powder, and taking out the tube;

d) unscrewing the cap which closes the sachet, and the top which closes the tube;

e) screwing the neck of the tube into the annular element of the attachment head of the sachet;

f) compressing the tube to expel substantially all its contents into the sachet;

g) unscrewing the tube from the annular element;

h) closing the sachet by screwing the cap back onto the attachment head;

i) kneading the sachet manually to obtain a substantially homogeneous mixture;

j) unscrewing the cap;

k) expelling the mixture, which has been obtained by kneading, from the sachet;

l) applying the mixture to the hair;

m) allowing the mixture to act for a period of time sufficient to obtain the desired lightening; and m) washing and drying the hair.

15. Method according to claim 14, wherein at the end of step g) a defined quantity of water, measured using the measuring cup previously separated from the container, is introduced into the sachet.

16. Method according to claim 14, wherein at the end of step j) an applicator nozzle is screwed onto the attachment head of the sachet, in place of the cap, and this applicator nozzle is used to apply the mixture to the hair.

17. Method according to claim 14, wherein at step k) the mixture is expelled into the dish, and at step l) the mixture is taken from the dish with the aid of an applicator.

18. Method according to claim 14, wherein at step k) the mixture is expelled by rolling the bag of the sachet around the small bars set in the weld seam at the bottom of the bag.

* * * * *